US012320542B2

(12) United States Patent
McNulty et al.

(10) Patent No.: US 12,320,542 B2
(45) Date of Patent: Jun. 3, 2025

(54) PARALLEL-WALLED VENTILATION DUCT ASSEMBLY WITH INTEGRATED LOW-PROFILE SUBDUCTS

(71) Applicant: Subduct Riser Manufacturing, LLC, Southlake, TX (US)

(72) Inventors: Timothy Edward McNulty, Southlake, TX (US); Thaddeus James Rohskopf, Fort Worth, TX (US); Brian William Ryglewicz, Glen Rock, NJ (US)

(73) Assignee: Subduct Riser Manufacturing, LLC, Southlake, TX (US)

( * ) Notice: Subject to any disclaimer, the term of this patent is extended or adjusted under 35 U.S.C. 154(b) by 304 days.

(21) Appl. No.: 18/051,232

(22) Filed: Oct. 31, 2022

(65) Prior Publication Data

US 2024/0142132 A1 May 2, 2024

(51) Int. Cl.
*F24F 13/02* (2006.01)
*F24F 13/24* (2006.01)

(52) U.S. Cl.
CPC ..... *F24F 13/0281* (2013.01); *F24F 13/0245* (2013.01); *F24F 13/24* (2013.01)

(58) Field of Classification Search
CPC .... F24F 13/02; F24F 13/0281; F24F 13/0245; F24F 13/24; F24F 2013/242
See application file for complete search history.

(56) References Cited

U.S. PATENT DOCUMENTS

| | | | |
|---|---|---|---|
| 8,267,759 | B2 | 9/2012 | McNulty et al. |
| 9,441,852 | B2 | 9/2016 | Edgar et al. |
| 2019/0224937 | A1* | 7/2019 | Fanelli ..... B32B 15/088 |

* cited by examiner

*Primary Examiner* — Jeremy A Luks
(74) *Attorney, Agent, or Firm* — Whitaker Chalk Swindle & Schwartz PLLC; Juan Vasquez

(57) ABSTRACT

A parallel-walled ventilation duct assembly with integrated low-profile subducts, and/or methods of manufacturing the assembly are provided. The assembly of embodiments includes a main shaft body defined by at least one wall surrounding an interior cavity and at least one low-profile subduct disposed within the interior cavity. The cross-sectional area of the main shaft body has a rectangular or an obround shape. The low-profile subduct includes an interior channel defined by a plurality of walls. The low-profile subduct is integrated into at least one wall of the main shaft body such that at least one wall of the plurality of walls of the low-profile subduct includes at least a portion of an interior surface of the at least one wall of the main shaft body, and the portion of the interior surface of the at least one wall includes a flat portion of the interior surface.

20 Claims, 5 Drawing Sheets

PARALLEL-WALLED VENTILATION DUCT ASSEMBLY WITH INTEGRATED LOW-PROFILE SUBDUCTS

TECHNICAL FIELD

The present disclosure relates generally to exhausting devices, and more particularly to a parallel-walled ventilation duct assembly with integrated low-profile subducts.

BACKGROUND

Current ventilation systems operate by guiding exhausts through a series of ducts into a main ventilation shaft. In typical ventilation systems, the main ventilation shaft may be an interior shaft into which the exhaust from various appliances and/or rooms within a building may be injected and then routed to the exterior of the building. In these typical systems, the dimensions of the main shaft are configured to ensure that there is enough pressure to carry the exhaust through the main shaft, as well as to ensure that building codes are observed. In particular, fire rated shafts have special requirements in the building codes, such as a requirement that a fire rated shaft should not be penetrated unless a fire damper is installed at the penetration point or a steel subduct is inserted that rises within the main shaft.

Currently, ventilation systems may be constructed on-site. In a typical ventilation system implementation, the main shaft may be fabricated or constructed by sheet metal workers. The main shaft may be fabricated to have a rectangular shape or rectangular cross-sectional area. At the work site, the main shaft may be installed onto a building's ventilation system to carry and route exhausts to the exterior of the building. Based on the ventilation system's requirements, one or more subducts may be added to the main shaft on-site to route exhaust from individual appliances or rooms into the main shaft. For example, a restroom exhaust fan may be connected to a duct that may in turn be connected to a subduct that is installed into the main shaft. In another example, a stove extractor may be connected (e.g., via one or more interior ducts) to a subduct that is installed into the main shaft. In this manner, the subducts may be used to route exhaust from individual appliances or rooms into the main shaft.

However, installation of the subducts into the rectangular main shaft may be difficult, labor intensive, and costly. For example, a subduct may be typically installed onto a main shaft from the inside of the main shaft. This may complicate the installation, increasing the time it takes to construct the ventilation system and thus, increasing the cost of construction.

In addition, the shape of the subduct may create further difficulties when installing the subduct onto the main shaft. For example, a round subduct may be difficult and awkward to install in the rectangular main shaft, as installing a round subduct onto an interior wall of a main shaft often requires strapping and guides to ensure that the round subduct is stable within the main shaft. Although some subducts are configured be installed flush against the inner wall of the main shaft, even installing these subducts onto the main shaft significantly increases the labor costs.

Another drawback of current techniques for on-field construction and installation of ventilation systems includes complications with complying with current building codes when the ventilation system is used for hot exhaust ventilation (e.g., dryer exhaust, heater exhausts, etc.). For example, current building codes do not allow obstructions within a hot exhaust system, such as a dryer exhaust, to prevent accumulation of potentially flammable materials (e.g., lint) within the ducts and to allow for easy cleaning of the ducts. Obstructions may include sheet metal screws, straps, guides, etc., which are frequently used in on-filed constructions of ventilation systems, and in particular for installation of subducts within a main shaft, especially by workers that may not be fully informed of compliance requirements.

Some solutions have been proposed to deal with problems associated with on-field construction and installation of ventilation systems as described above. A particular solution proposes the use of a round main shaft assembly with integrated subducts. However, this solution is lacking as a round shaft uses more space within an area for a particular performance. For example, main shafts are typically installed or hidden behind a wall, which is typically not a round area. In this case, a round main shaft behind a wall may be deficient as it does not maximize the area behind the wall.

BRIEF SUMMARY

The present disclosure achieves technical advantages as a parallel-walled ventilation duct assembly with integrated low-profile subducts for ventilation systems, and/or methods of manufacturing a parallel-walled ventilation duct assembly with integrated low-profile subducts. In particular embodiments, the ventilation duct assembly with integrated low-profile subducts of embodiments may include a main shaft body and at least one low-profile subduct. In embodiments, the main shaft body may include at least one wall defining an interior cavity of the main shaft body. The interior cavity of the main shaft body may extend from a proximal end to a distal end of the main shaft body along a longitudinal axis, and at least a portion of the at least one wall is disposed along two parallel axes perpendicular to the longitudinal axis. In embodiments, the at least one low-profile subduct, which in some embodiments may include a single low-profile subduct or may include a plurality of low-profile subducts, may be disposed within the interior cavity of the main shaft body between the proximal end and the distal end of the main shaft body. In embodiments, the at least one low-profile subduct may include an interior channel, which may be defined by a plurality of walls. The at least one low-profile subduct may also include an intake channel coupled to the interior channel, and the interior channel and the intake channel may form an exhaust channel configured to route exhaust into the interior cavity of the main shaft body through the at least one low-profile subduct. In embodiments, the at least one low-profile subduct may be integrated into the at least one wall of the main shaft body such that at least one wall of the plurality of walls of the at least one low-profile subduct includes at least a portion of an interior surface of the at least one wall of the main shaft body. In embodiments, the at least a portion of the interior surface of the at least one wall of the main shaft body into which the at least one low-profile subduct is integrated may include a flat portion of the interior surface. For example, in some embodiments, the shape of the main shaft body may be rectangular or obround. In these embodiments, the at least one wall may include at least a flat portion into which the at least one low-profile subduct may be integrated.

It is an object of the disclosure to provide a ventilation duct assembly with integrated low-profile subducts for ventilation systems. It is a further object of the disclosure to provide a method of manufacturing a ventilation duct assembly with integrated low-profile subducts for ventilation systems.

In one particular embodiment, a ventilation duct assembly with integrated low-profile subducts is provided. The ventilation duct assembly includes a main shaft body including at least one wall defining an interior cavity of the main shaft body. In embodiments, the interior cavity of the main shaft body may extend from a proximal end to a distal end of the main shaft body along a longitudinal axis, and at least a portion of the at least one wall may be disposed along two parallel axes perpendicular to the longitudinal axis. The ventilation duct assembly may also include at least one low-profile subduct disposed within the interior cavity of the main shaft body between the proximal end and the distal end of the main shaft body. In embodiments, the at least one low-profile subduct may include an interior channel defined by a plurality of walls of the at least one low-profile subduct and an intake channel coupled to the interior channel, and the interior channel and the intake channel may form an exhaust channel configured to route exhaust from an exhaust source into the interior cavity of the main shaft body. In embodiments, the at least one low-profile subduct may be integrated into the at least one wall of the main shaft body such that at least one wall of the plurality of walls of the at least one low-profile subduct includes at least a portion of an interior surface of the at least one wall of the main shaft body, and the at least a portion of the interior surface of the at least one wall of the main shaft body may include a flat portion of the interior surface.

In another embodiment, a method of manufacturing a ventilation duct assembly with integrated low-profile subducts is provided. The method includes disposing at least one wall defining a main shaft body around an interior cavity of the main shaft body. In embodiments, the interior cavity of the main shaft body may extend from a proximal end to a distal end of the main shaft body along a longitudinal axis. In embodiments, disposing the at least one wall may include disposing at least a portion of the at least one wall along two parallel axes perpendicular to the longitudinal axis. The method also includes attaching at least one low-profile subduct to an interior surface of the at least one wall. In embodiments, the at least one low-profile subduct may be disposed within the interior cavity of the main shaft body between the proximal end and the distal end of the main shaft body. In embodiments, attaching the at least one low-profile subduct to the interior surface of the at least one wall may form an interior channel of the at least one low-profile subduct. In embodiments, the at least one low-profile subduct may be integrated into the at least one wall of the main shaft body such that the at least one low-profile subduct and the interior surface of the at least one wall share at least a portion of the interior surface, and the at least a portion shared by the at least one low-profile subduct and the interior surface of the at least one wall may include a flat portion of the interior surface The foregoing has outlined rather broadly the features and technical advantages of the present disclosure in order that the detailed description of the disclosure that follows may be better understood. Additional features and advantages of the disclosure will be described hereinafter which form the subject of the claims of the disclosure. It should be appreciated by those skilled in the art that the conception and specific embodiment disclosed may be readily utilized as a basis for modifying or designing other structures for carrying out the same purposes of the present disclosure. It should also be realized by those skilled in the art that such equivalent constructions do not depart from the spirit and scope of the disclosure as set forth in the appended claims. The novel features which are believed to be characteristic of the disclosure, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

For a more complete understanding of the present disclosure, reference is now made to the following descriptions taken in conjunction with the accompanying drawings, in which.

Figure 1B:
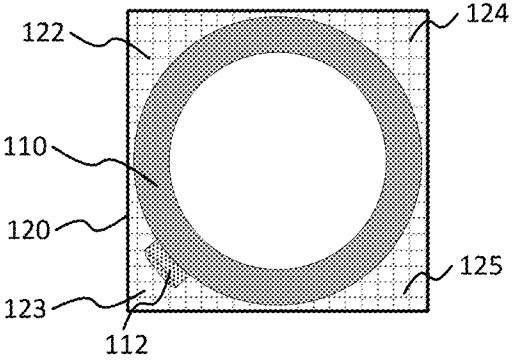
FIG. 1B (PRIOR ART)
FIG. 1B illustrate another example of a double-walled round main shaft assembly as proposed in the prior art.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION

The disclosure presented in the following written description and the various features and advantageous details thereof, are explained more fully with reference to the non-limiting examples included in the accompanying drawings and as detailed in the description. Descriptions of well-known components have been omitted to not unnecessarily obscure the principal features described herein. The examples used in the following description are intended to facilitate an understanding of the ways in which the disclosure can be implemented and practiced. A person of ordinary skill in the art would read this disclosure to mean that any suitable combination of the functionality or exemplary embodiments below could be combined to achieve the subject matter claimed. The disclosure includes either a representative number of species falling within the scope of the genus or structural features common to the members of the genus so that one of ordinary skill in the art can recognize the members of the genus. Accordingly, these examples should not be construed as limiting the scope of the claims.

A person of ordinary skill in the art would understand that any system claims presented herein encompass all of the elements and limitations disclosed therein, and as such, require that each system claim be viewed as a whole. Any reasonably foreseeable items functionally related to the claims are also relevant. Pursuant to Section 904 of the Manual of Patent Examination Procedure, the Examiner, after having obtained a thorough understanding of the disclosure disclosed and claimed in the nonprovisional application has searched the prior art as disclosed in patents and other published documents, i.e., nonpatent literature. Therefore, as evidenced by the issuance of this patent, the prior art fails to disclose or teach the elements and limitations presented in the claims as enabled by the specification and drawings, such that the presented claims are patentable under 35 U.S.C. §§ 101, 102, 103, and 112.

Various embodiments of the present disclosure are directed to a parallel-walled ventilation duct assembly with integrated low-profile subducts, and/or methods of manufacturing a parallel-walled ventilation duct assembly with integrated low-profile subducts. As noted above, in typical ventilation system implementations, a worker fabricates a rectangular main shaft, and then installs any required subducts onto the main shaft on-site. However, such current techniques create a host of problems. For example, as also mentioned above, on-site installation of the subducts onto the rectangular main shaft is difficult, labor intensive, and costly, as subducts are typically installed onto a main shaft from the inside of the main shaft. In addition, installing a round subduct a rectangular main shaft often requires strapping, screw, and/or guides to ensure that the round subduct is stable within the main shaft, which increases the cost and complexity of on-site installation of subducts onto a main shaft. Moreover, such on-site installation may run afoul of fire-safety requirements, such as a requirement to maintain the interior of hot exhaust ducts free from obstructions, which straps, screws, guides, etc. may represent.

Figure 1A:
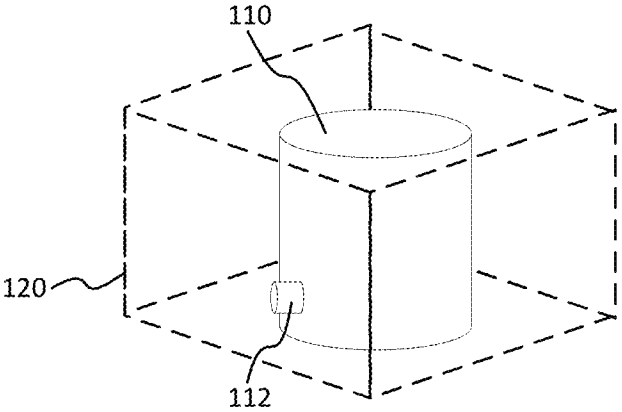
FIG. 1A (PRIOR ART)
FIG. 1A illustrates an example of a double-walled round main shaft assembly as proposed in the prior art.

As also mentioned above, a particular solution that has been proposed includes the use of a double-walled round main shaft assembly with integrated subducts. However, this solution is not ideal for dealing with current ventilation systems. FIGS. 1A and 1B illustrate an example of a double-walled round main shaft assembly as proposed in the prior art. In particular, as shown in FIG. 1A, double-walled round main shaft assembly 110 may include a subduct 112, which may be installed within space 120. However, as mentioned above, one of the deficiencies of a double-walled round main shaft is that a double-walled round main shaft does not maximize the use of the space in which it is disposed and requires more space for a given performance. For example, as shown in FIG. 1B, round main shaft 110 does not maximize space 120, and thus, spaces 122, 123, 124, and 125 remain largely unused. Because of the deficiencies of a double-walled round main shaft, such a solution is not sufficient to address the problems with current ventilation systems.

Figure 2A:
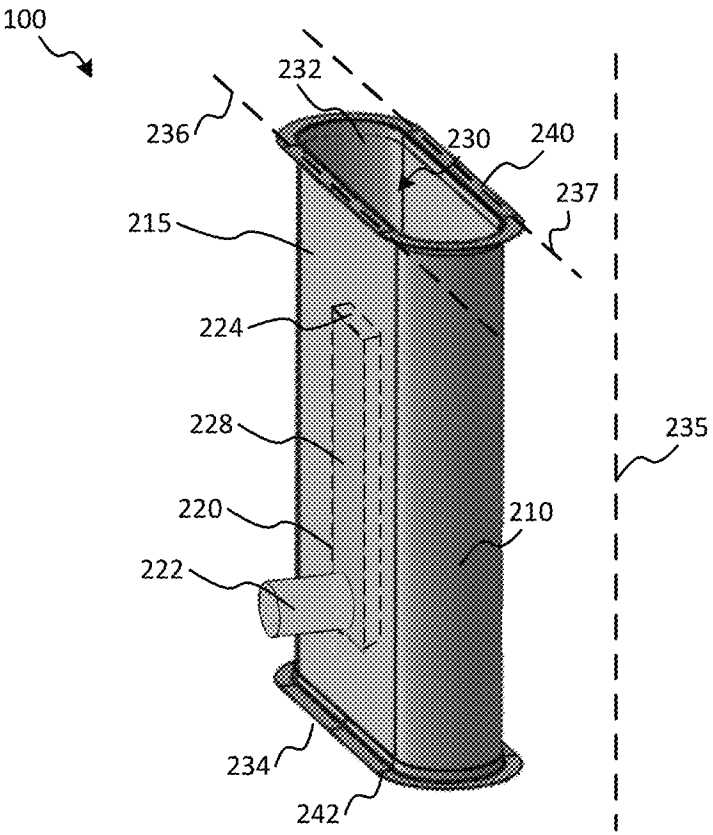
FIG. 2A shows a perspective view of an exemplary parallel-walled ventilation duct assembly with integrated low-profile subducts implemented in accordance with embodiments of the present disclosure.

FIG. 2A shows a perspective view of an exemplary parallel-walled ventilation duct assembly with integrated low-profile subducts implemented in accordance with embodiments of the present disclosure. As shown in FIG. 2A, parallel-walled ventilation duct assembly 100 includes main shaft body 210 and integrated low-profile subduct 220. These components may be configured to include various components and/or configurations for providing functionality as described in various embodiments of the present disclosure.

In embodiments, various components of parallel-walled ventilation duct assembly 100 (e.g., main shaft 210 and/or integrated low-profile subduct 220) may be fabricated of a metal material, such as steel, galvanized steel, aluminum, etc. In some embodiments, the various components of parallel-walled ventilation duct assembly 100 may be machined or preformed separately, such as using a one-piece construction to fabricate main shaft 210 and/or integrated low-profile subduct 220, and may then be attached together to form parallel-walled ventilation duct assembly 100.

In embodiments, main shaft body 210 may include at least one wall defining an interior cavity of main shaft 210. For example, interior cavity 230 of main shaft body 210 may be defined by at least one wall. Interior cavity 230 may represent a channel through which exhaust may be carried to the exterior of a building into which parallel-walled ventilation duct assembly 100 may be installed. In embodiments, interior cavity 230 may extend from proximal end 234 of main shaft body 210 to distal end 232 of main shaft body 210 along longitudinal axis 235.

In embodiments, main shaft body 210 may represent a modular component and may be configured to connect to other ventilation system components, such as connectors or ducts (e.g., other parallel-walled ventilation duct assemblies or other types of ducts) to form the ventilation system. To that end, in some embodiments, main shaft body 210 may include one or more mounting elements, such as mounting elements 240 and 242. In embodiments, each of mounting elements 240 and 242 may be disposed at a respective end of main shaft body 210. For example, mounting element 240 may be disposed on distal end 232 of main shaft body 210 and mounting element 242 may be disposed on proximate end 234 of main shaft body 210. Each of mounting elements 240 and 242 may include a ridge, tab, surface, or area, configured to support and allow a fastening mechanism (e.g., such as screws, ties, clasps, clamps, etc.) to attach and secure main shaft body 210 to one or more other components of a ventilation system, as described above.

In some embodiments, the exterior surface of each of mounting elements 240 and 242 may operate to provide further mounting points for main shaft body 210. For example, in some embodiments, the bottom surface of each of mounting elements 240 and 242 may be configured to include an adhesive surface (e.g., glue, adhesive tape, or any other adhesive substance) that may attach to one or more other components of a ventilation system and may provide a further securing force securing main shaft body 210 to the one or more other components of a ventilation system.

In embodiments, interior cavity 230 of main shaft body 210 may be defined by the interior surface of the at least one wall of main shaft body 210. For example, the at least one wall may include an exterior surface and an interior surface. The at least one wall may define interior cavity 230 and the interior surface of the at least one wall may face interior cavity 230.

In embodiments, the at least one wall defining interior cavity 230 may include a single wall. For example, in the example illustrated in FIG. 2A, the at least one wall includes a single wall 215. In some embodiments, single wall 215 may represent a continuous segment of material that is formed into a shape of main shaft body 210. For example, the continuous segment of material may be bent, twisted, or otherwise formed into the shape configured for main shaft body 210. In alternate embodiments, single wall 215 may represent a set of contiguous segments of material attached together and formed into a shape of main shaft body 210. For example, a plurality of segments of material may be attached, each segment to another segment, to form a "sheet" of material representing a set of continuous segments of material, which may then be bent, twisted, or otherwise formed into the shape configured for main shaft body 210.

Figure 2B:
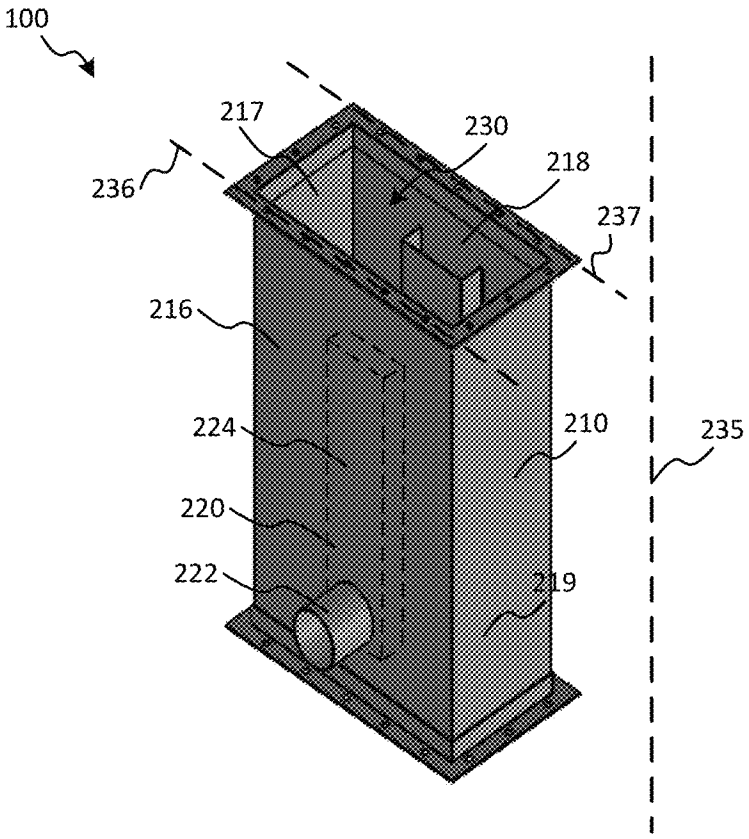
FIG. 2B shows a perspective view of another exemplary parallel-walled ventilation duct assembly with integrated low-profile subducts implemented in accordance with embodiments of the present disclosure.

In some embodiments, the at least one wall defining interior cavity 230 may include a plurality of walls. For example, FIG. 2B shows a perspective view of another exemplary parallel-walled ventilation duct assembly with integrated low-profile subducts implemented in accordance with embodiments of the present disclosure. In the example illustrated in FIG. 2B, the at least one wall defining cavity 230 includes walls 216, 217, 218, and 219. In some embodiments, walls 216, 217, 218, and 219 may represent a continuous segment of material that is formed into a shape of main shaft body 210 including walls 216, 217, 218, and 219. In alternate embodiments, each of walls 216, 217, 218, and 219 may represent a segment of material, and each segment of material is attached to another segment of material to form a shape of main shaft body 210. For example, an end of the segment of material representing wall 216 may be attached to one end of the segment of material representing wall 217, while the other end of the segment of material representing wall 217 may be attached to one end of the segment of material representing wall 218. The other end of the segment of material representing wall 218 may be attached to one end of the segment of material representing wall 219, while the other end of the segment of material representing wall 219 may be attached to the other segment of material representing wall 216, forming a set of contiguous segments of material. The set of contiguous segments of material may then be bent, twisted, or otherwise formed into the shape configured for main shaft body 210.

It is noted at this point that the shape of main shaft body 210 may be configured to optimize and/or maximize the use of the space in which parallel-walled ventilation duct assembly 100 is to be installed and/or mounted. These features of parallel-walled ventilation duct assembly 100 provide an improvement over current systems, as the configured shape of main shaft body 210 enables a ventilation system to maximize the use of the space while also providing superior performance to a performance provided by, for example, a round ventilation duct within the same space. In some embodiments, the superior performance of parallel-walled ventilation duct assembly 100 may enable builders to reduce the size of the ventilation ducts while maintaining a desired level of performance, which may result in material savings as well as space savings allowing developers or architects more freedom (e.g., in terms of area) to design buildings.

In particular, the shape of main shaft body 210 may be configured to be a parallel-walled shape. In embodiments, a parallel-walled shape of main shaft body 210 may refer to a shape in which at least a portion of the at least one wall of main shaft body 210 is disposed flatly within parallel axes perpendicular to longitudinal axis 235. For example, as shown in FIG. 2B, main shaft body 210 may have a rectangular shape. In these embodiments, the at least one wall of main shaft body 210 may include a plurality of walls (e.g., walls 216, 217, 218, and 219). In embodiments, at least a portion of the plurality of walls may be disposed flatly within axis 236 and axis 237, which may be parallel to each other and perpendicular to longitudinal axis 235. For example, wall 216, which may represent a flat portion, may be disposed flatly within axis 236 and wall 218, which may also represent a flat portion, may be disposed flatly within axis 237. In this example, walls 217 and 219 may be flat and may be perpendicular to parallel axes 236 and 237.

With reference to FIG. 2A, main shaft body 210 may have an obround shape, in which at least a portion of single wall 215 (e.g., the parallel lines of the obround shape) may be disposed flatly within axis 236 and axis 237. Axes 236 and 237 may be perpendicular to longitudinal axis 235. In addition, the endpoints of single wall 215 (e.g., the semicircles of the obround shape) may be rounded. Further details of the features of the obround shape of main shaft body 210 are illustrated with reference to FIG. 3.

Figure 3:
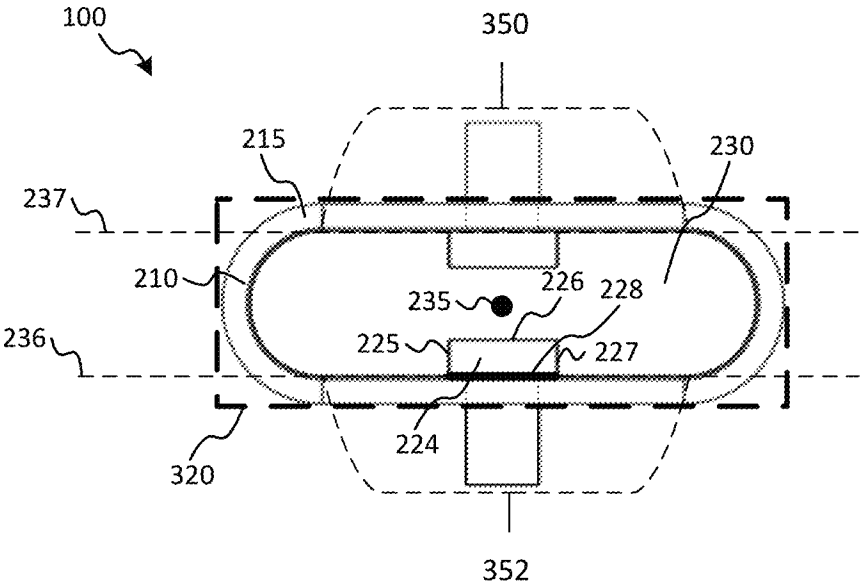
FIG. 3 shows a top view of a parallel-walled ventilation duct assembly implemented in accordance with embodiments of the present disclosure.

FIG. 3 shows a top view of parallel-walled ventilation duct assembly 100 implemented in accordance with embodiments of the present disclosure. In particular, FIG. 3 shows a view from the distal end of main shaft body 210. As can be seen, the shape of main shaft body 210 is an obround shape in which the parallel lines of the obround shape fall or are disposed within axis 236 and axis 237, which are perpendicular to longitudinal axis 235. In this case, at least a portion of single wall 215, which may include flat portion 350 and flat portion 352, may be disposed flatly within axis 236 and axis 237 (e.g., portion 352 may be disposed flatly within axis 236 and portion 350 may be disposed flatly within axis 237).

As also illustrated in FIG. 3, parallel-walled ventilation duct assembly 100 may be mounted, positioned, or otherwise installed within space 320. Space 320 may be a rectangular space, as it is often where ventilation ducts are installed. In this case, parallel-walled ventilation duct assembly 100 may be configured to optimize the use of space 320, as parallel-walled ventilation duct assembly 100 may use more of space 320 than a round ventilation duct may use. In this manner, the configuration of main shaft body 210 allows parallel-walled ventilation duct assembly 100 to have a greater performance (e.g., a greater pressure within the ventilation system) than a round ventilation duct in the same space. Indeed, a round ventilation duct may require a significantly larger size (e.g., an interior cavity of a much larger size than the interior cavity 230 of parallel-walled ventilation duct assembly 100) in order to obtain the same performance as the performance obtained by the obround shape of parallel-walled ventilation duct assembly 100. For example, in a particular application, such as a typical bathroom exhaust system, a wall gap of 12 inches may be required to obtain a particular performance with a round ventilation duct, whereas the same particular performance may be obtained with an obround ventilation duct requiring an 8 inch wall gap.

Additionally, the obround shape of main shaft body 210 may also operate to optimize material usage. For example, the endpoints of main shaft body 210 (e.g., the semicircles of the obround shape) may be rounded, which reduces the amount of material used (e.g., from a rectangular design, for example). Furthermore, the obround shape of main shaft body 210 may also operate to optimize manufacturing, as an obround shape may be easier to manufacture and may be fabricated from a single segment of material.

In some embodiments, the size of the main shaft body 210 (e.g., the size of the cross-sectional area of main shaft body 210 and/or the height of main shaft body 210) may be determined by operational requirements. For example, in some cases, a large amount of exhaust may be required to be moved through the ventilation system. In these cases, main shaft body 210 may be configured with a large size. In some cases, the amount of exhaust required to be moved through the ventilation system may be small. In these cases, main shaft body 210 may be configured with a smaller size. In some embodiments, the size of main shaft body 210 may range from 6×8 inches to 30×48 inches.

With reference back to FIG. 2A, in embodiments, integrated low-profile subduct 220 may be configured to carry or route exhaust into interior cavity 230 from an exhaust source. As noted above, interior cavity 230 may be configured to further route the exhaust to the exterior of a building. In embodiments, integrated low-profile subduct 220 may include a channel for carrying or routing the exhaust into interior cavity 230 from the exhaust source. For example, integrated low-profile subduct 220 may include horizontal section 222 and vertical section 224, and in these embodiments, the channel of integrated low-profile subduct 220 may be formed by the cooperative arrangement of horizontal section 222 and vertical section 224.

Horizontal section 222 may be a tubular or cylindrical section with an open diameter forming an intake channel through which exhaust from an exhaust source may enter integrated low-profile subduct 220. In embodiments, horizontal section 222 may be disposed in an opening through single wall 215, and in this manner, at least a portion of horizontal section 222 may be disposed on the exterior of main shaft body 210. In embodiments, the diameter of horizontal section 222 may be based on operational requirements. For example, in some embodiments, horizontal section 222 may be coupled to an exhaust duct carrying the exhaust from the exhaust source (e.g., an appliance, equipment, a room, etc.). In these cases, the diameter of horizontal section 222 may be determined based on the diameter of the exhaust duct to which horizontal section 222 is to be coupled. In embodiments, the diameter of horizontal section 222 may be between 2-10 inches, although this is intended for illustrative purposes and not by way of limitation. Indeed, other diameters for horizontal section 222 may be used in accordance with embodiments of the present disclosure.

In embodiments, vertical section 224 of integrated low-profile subduct 220 may be disposed within interior cavity 230 of main shaft body 210. For example, vertical section 224 may extend vertically, along longitudinal axis 235, within interior cavity 230 over a span between proximal end 234 and distal end 232 of main shaft body 210. In embodiments, the span between proximal end 234 and distal end 232 of main shaft body 210 over which vertical section 224 may extend may represent a length of vertical section 224. In embodiments, the length of vertical section 224 may be any length up to the length defined between proximal end 234 and distal end 232 of main shaft body 210. In this manner, vertical section 224 may be any length up to the length of main shaft body 210.

In embodiments, vertical section 224 may include an interior channel defined by a plurality of walls. Vertical section 224 may be coupled to horizontal section 222 such that the interior channel of vertical section 224 and the intake channel of horizontal section 222 may form the channel of integrated low-profile subduct 220 for carrying or routing the exhaust into interior cavity 230 from the exhaust source.

In embodiments, vertical section 224 may be configured to integrate low-profile subduct 220 into main shaft body 210 of parallel-walled ventilation duct assembly 100. In particular, in some embodiments, as noted above, vertical section 224 may include a plurality of walls defining the interior channel of vertical section 224. For example, FIG. 3 illustrates vertical section 224 including walls 225-228 defining the interior channel of vertical section 224. In some embodiments, at least one of the walls of vertical section 224 includes at least a portion of the interior surface of the at least one wall of main shaft body 210. In these embodiments, vertical section 224 and main shaft body 210 may share at least a portion of the at least one wall of main shaft body 210. For example, wall 228 of vertical section 224 may be a portion of the interior surface of single wall 215 of main shaft body 210. In this manner, vertical section 224 may be integrated into main shaft body 210. With reference back to FIG. 2A, it is illustrated that wall 228 of vertical section 224 may be shared with single wall 215. In embodiments, the portion of single wall 215 forming the integrated wall of vertical section 224 may include a flat portion of single wall 215. For example, as seen in FIG. 2A, wall 228 may include a portion of single wall 215 that is flat and disposed within the parallel sides of the obround shape of main shaft body 210.

In embodiments, such as in the example illustrated in FIGS. 2A and 3, vertical section 224 may be fabricated by attaching walls 225, 226, and 227 to single wall 215. In embodiments, walls 225, 226, and 227 may be attached to single wall 215 using any mechanism suitable for attaching a metal component to another metal components, and may include welding, gluing, soldering, etc. In some embodiments, integrating integrated low-profile subduct 220 into main shaft body 210 of parallel-walled ventilation duct assembly 100 may exclude the use of sheet metal screws, guides, strapping, etc., typically used in field installation. This provides a benefit in that the interior channels of integrated low-profile subduct 220 remain unobstructed as required by many fire-safety codes.

In embodiments, integrated low-profile subduct 220 may be configured as a low-profile subduct. A low-profile subduct may be configured to optimize the flow of exhaust within interior cavity 230. For example, vertical section 224, which may be the portion of integrated low-profile subduct 220 disposed within interior cavity 230, may be configured to occupy a minimum amount of space within interior cavity 230. In embodiments, vertical section 224 may be configured with a rectangular cross-sectional area (e.g., a rectangular cross-sectional area defined by walls 225-228), which may provide superior performance when compared to a subduct with a round cross-sectional area. For example, the rectangular shape of the cross-sectional area of integrated low-profile subduct 220 results in a reduction of the pressure drop within interior cavity 230 caused by integrated low-profile subduct 220. In this manner, integrated low-profile subduct 220 may represent a lower profile within interior cavity 230 than a typical round subduct.

In some embodiments, the rectangular cross-sectional area of integrated low-profile subduct 220 may be reduced, in comparison to the use of a round shaped subduct, without an increase in the pressure drop within interior cavity 230 due to integrated low-profile subduct 220. In these embodiments, the low-profile of integrated low-profile subduct 220 allows for a reduction in material usage, as the size of integrated low-profile subduct 220 may be reduced, when compared to a round subduct, while maintaining the same performance.

In some embodiments, integrated low-profile subduct 220 may allow for the size (e.g., the cross-sectional area) of main shaft body 210 to be reduced, while maintaining an acceptable level of performance (e.g., when compared to a round subduct). The reduction of the size (e.g., the cross-sectional area) of main shaft body 210 may result in a reduction in material usage, which may provide significant savings to users, developer, etc. In addition, the reduction of the size (e.g., the cross-sectional area) of main shaft body 210 may provide a significant benefit to developers, builders, users, etc., by allowing the recovery of usable space.

In embodiments, the integration of integrated low-profile subduct 220 into main shaft body 210, such as by sharing a portion of the interior surface of single wall 215 between integrated low-profile subduct 220 and main shaft body 210, may provide further material usage savings, as an additional (e.g., a fourth) wall does not need to be fabricated for vertical section 224 of integrated low-profile subduct 220. For example, vertical section 224 of integrated low-profile subduct 220 may be constructed by fabricating walls 225-227, and then attaching to the interior surface of single wall 215, which functions as the fourth wall forming the interior channel of vertical section 224.

In embodiments, parallel-walled ventilation duct assembly 100 may include a plurality of integrated low-profile subducts (e.g., integrated low-profile subduct 220). For example, one or more integrated low-profile subducts may be integrated into one or more sides of the at least one wall of main shaft body 210. In some embodiments, one or more integrated low-profile subducts may be integrated into one of the flat portions of the at least one wall of main shaft body 210 (e.g., flat portion disposed within axis 236) and one or more integrated low-profile subducts may be integrated into another one of the flat portions of the at least one wall of main shaft body 210 (e.g., flat portion disposed within axis 237).

In embodiments, parallel-walled ventilation duct assembly 100 may be configured with fire-resistance functionality. For example, the at least one wall of main shaft body 210 may be configured to be fire resistant. In some embodiments, the at least one wall of main shaft body 210 may be constructed of a fire-resistant material. In some embodiment, a fire-resistant material may be attached to at least a portion of a surface of the at least one wall of main shaft body 210. For example, the fire-resistant material may be attached to at least a portion of an interior and/or exterior surface of the at least one wall of main shaft body 210. In some embodiments, attaching the fire-resistant material to the at least a portion of the surface of the at least one wall of main shaft body 210 may include coating the surface of the at least one wall of main shaft body 210 with the fire-resistant material and/or securing (e.g., with straps, fasteners, screws, bolts, adhesives, etc.) the fire-resistant material to the at least a portion of the surface of the at least one wall of main shaft body 210.

In some embodiments, integrated low-profile subduct 220 may be configured to be fire resistant. For example, integrated low-profile subduct 220 may be constructed of a fire-resistant material and/or a fire-resistant material may be attached to at least a portion of a surface of at least one of the walls of integrated low-profile subduct 220. For example, the fire-resistant material may be attached to at least a portion of an interior and/or exterior surface of the at least one wall of integrated low-profile subduct 220. In some embodiments, attaching the fire-resistant material to the at least a portion of the surface of the at least one wall of integrated low-profile subduct 220 may include coating the surface of the at least one wall of integrated low-profile subduct 220 with the fire-resistant material and/or securing (e.g., with straps, fasteners, screws, bolts, adhesives, etc.) the fire-resistant material to the at least a portion of the surface of the at least one wall of integrated low-profile subduct 220.

In embodiments, parallel-walled ventilation duct assembly 100 may be configured with acoustic insulation functionality. For example, at least one wall of main shaft body 210 may be constructed of material providing acoustic insulation. In some embodiment, an acoustic insulation material may be attached to at least a portion of a surface of the at least one wall of main shaft body 210. For example, the acoustic insulation material may be attached to at least a portion of an interior and/or exterior surface of the at least one wall of main shaft body 210. In some embodiments, attaching the acoustic insulation material to the at least a portion of the surface of the at least one wall of main shaft body 210 may include coating the surface of the at least one wall of main shaft body 210 with the acoustic insulation material and/or securing (e.g., with straps, fasteners, screws, bolts, adhesives, etc.) the acoustic insulation material to the at least a portion of the surface of the at least one wall of main shaft body 210.

In some embodiments, integrated low-profile subduct 220 may be configured with acoustic insulation functionality. For example, integrated low-profile subduct 220 may be constructed of an acoustic insulation material and/or an acoustic insulation material may be attached to at least a portion of a surface of at least one of the walls of integrated low-profile subduct 220. For example, the acoustic insulation material may be attached to at least a portion of an interior and/or exterior surface of the at least one wall of integrated low-profile subduct 220. In some embodiments, attaching the acoustic insulation material to the at least a portion of the surface of the at least one wall of integrated low-profile subduct 220 may include coating the surface of the at least one wall of integrated low-profile subduct 220 with the acoustic insulation material and/or securing (e.g., with straps, fasteners, screws, bolts, adhesives, etc.) the acoustic insulation material to the at least a portion of the surface of the at least one wall of integrated low-profile subduct 220. In some embodiments, integrated low-profile subduct 220 may be constructed as a double-walled subduct. In these embodiments, at least one wall of integrated low-profile subduct 220 may be constructed as a double wall. In some embodiments, the acoustic insulation material may be disposed between the two walls of the at least one double-wall of integrated low-profile subduct 220. For example, the acoustic insulation material may be sandwiched between the two walls of the at least one double wall of integrated low-profile subduct 220. In embodiments, the at least one double wall may include a wall of horizontal section 222 and/or a wall of vertical section 224 of integrated low-profile subduct 220.

Figure 4:
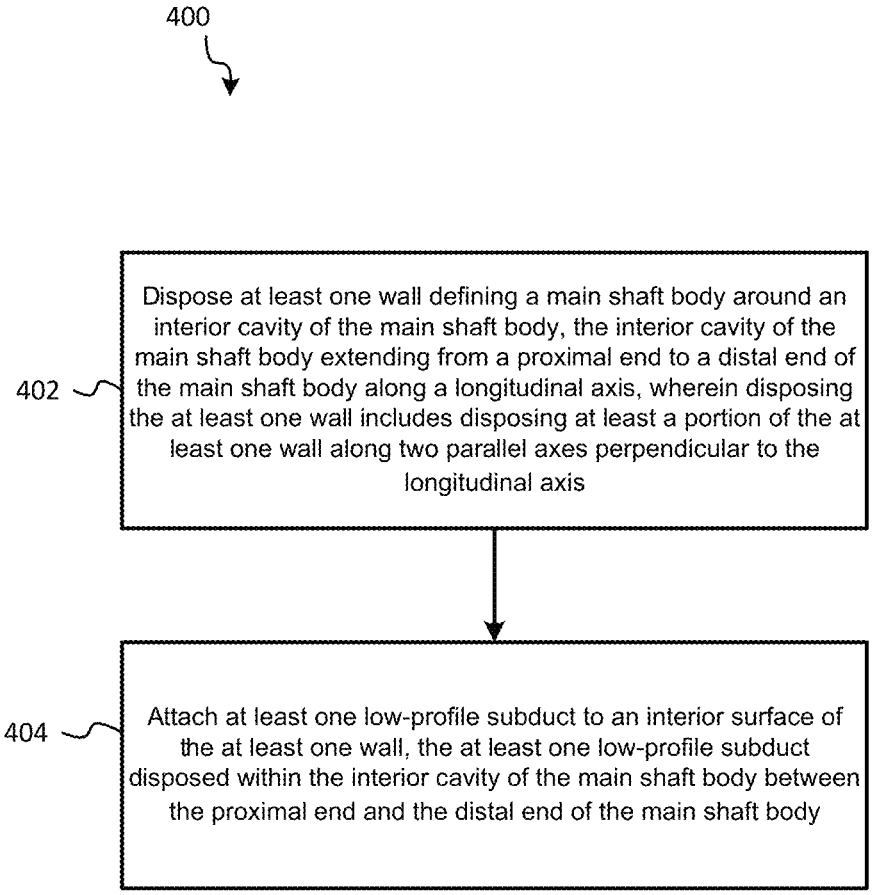
FIG. 4 shows an exemplary flow diagram of operations for manufacturing a parallel-walled ventilation duct assembly with integrated low-profile subducts configured in accordance with embodiments of the present disclosure.

FIG. 4 shows an exemplary flow diagram 400 of operations for manufacturing a parallel-walled ventilation duct assembly with integrated low-profile subducts configured in accordance with embodiments of the present disclosure. For example, the steps illustrated in the example blocks shown in FIG. 4 may be performed to manufacture parallel-walled ventilation duct assembly 100 of FIGS. 2A-3, according to embodiments herein.

At block 402, at least one wall defining a main shaft body may be disposed around an interior cavity of the main shaft body. For example, the at least one wall (e.g., single wall 215 or any of plurality of walls 216-218) of main shaft body 210 may be disposed around interior cavity 230 as illustrated in FIGS. 2A-3. In embodiments, the interior cavity of the main shaft body may extend from a proximal end to a distal end of the main shaft body along a longitudinal axis. In embodiments, disposing the at least one wall around the interior cavity may include disposing at least a portion of the at least one wall along two parallel axes perpendicular to the longitudinal axis along which the main shaft body is disposed.

At block 404, at least one low-profile subduct may be attached to an interior surface of the at least one wall. For example, integrated low-profile subduct 220 may be attached to the interior surface of the at least one wall (e.g., single wall 215 or any of plurality of walls 216-218) of main shaft body 210 as illustrated in FIGS. 2A-3. In embodiments, the at least one low-profile subduct may be disposed within the interior cavity of the main shaft body between the proximal end and the distal end of the main shaft body. In embodiments, attaching the at least one low-profile subduct to the interior surface of the at least one wall may form an interior channel of the at least one low-profile subduct. In embodiments, the at least one low-profile subduct may be integrated into the at least one wall of the main shaft body such that the at least one low-profile subduct and the interior surface of the at least one wall share at least a portion of the interior surface. In embodiments, the at least a portion shared by the at least one low-profile subduct and the interior surface of the at least one wall may include a flat portion of the interior surface.

In embodiments, the at least one wall defining the main shaft body may be formed with a cross-sectional area having an obround shape defined by two parallel sides and two round endpoints. In embodiments, a first of the two parallel sides may correspond to a first of the two parallel axes perpendicular to the longitudinal axis and a second of the two parallel sides corresponds to a second of the two parallel axes perpendicular to the longitudinal axis. In embodiments, a first portion of the at least a portion of the at least one wall may be disposed along the first of the two parallel sides parallel axes and a second portion of the at least a portion of the at least one wall is disposed along the second of the two parallel sides.

In embodiments, the at least one wall defining the main shaft body may be formed with a cross-sectional area having a rectangular shape defined by four sides including two parallel sides. In embodiments, a first of the two parallel sides may correspond to a first of the two parallel axes perpendicular to the longitudinal axis and a second of the two parallel sides corresponds to a second of the two parallel axes perpendicular to the longitudinal axis. In embodiments, a first portion of the at least a portion of the at least one wall may be disposed along the first of the two parallel sides parallel axes and a second portion of the at least a portion of the at least one wall is disposed along the second of the two parallel sides.

In some embodiments, the at least one wall of the main shaft body and/or the at least one low-profile subduct may be fabricated using a fire-resistant material. In some embodiments, the at least one wall of the main shaft body and/or the at least one low-profile subduct may be fabricated using an acoustic insulated material.

In some embodiments, at least a portion of an interior surface of the at least one wall of the main shaft body and/or at least a portion of an interior surface of the interior channel of the at least one low-profile subduct may be coated with a fire-resistant layer. In some embodiments, at least a portion of an interior surface of the at least one wall of the main shaft body and/or at least a portion of an interior surface of the interior channel of the at least one low-profile subduct may be coated with an acoustic insulation layer.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

Moreover, the description in this patent document should not be read as implying that any particular element, step, or function can be an essential or critical element that must be included in the claim scope. Also, none of the claims can be intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," "processing device," or "controller" within a claim can be understood and intended to refer to structures known to those skilled in the relevant art, as further modified or enhanced by the features of the claims themselves, and can be not intended to invoke 35 U.S.C. § 112(f). Even under the broadest reasonable interpretation, in light of this paragraph of this specification, the claims are not intended to invoke 35 U.S.C. § 112(f) absent the specific language described above.

The disclosure may be embodied in other specific forms without departing from the spirit or essential characteristics thereof. For example, each of the new structures described herein, may be modified to suit particular local variations or requirements while retaining their basic configurations or structural relationships with each other or while performing the same or similar functions described herein. The present embodiments are therefore to be considered in all respects as illustrative and not restrictive. Accordingly, the scope of the disclosures can be established by the appended claims rather than by the foregoing description. All changes which come within the meaning and range of equivalency of the claims are therefore intended to be embraced therein. Further, the individual elements of the claims are not well-understood, routine, or conventional. Instead, the claims are directed to the unconventional inventive concept described in the specification.

What is claimed is:

1. A ventilation duct assembly with integrated low-profile subducts, the ventilation duct assembly comprising:

a main shaft body including at least one wall defining an interior cavity of the main shaft body, the interior cavity of the main shaft body extending from a proximal end to a distal end of the main shaft body along a longitudinal axis, wherein at least a portion of the at least one wall is disposed along two parallel axes perpendicular to the longitudinal axis, wherein a cross-sectional area of the main shaft body has an obround shape defined by two parallel sides and two round endpoints; and at least one low-profile subduct disposed within the interior cavity of the main shaft body between the proximal end and the distal end of the main shaft body, wherein the at least one low-profile subduct includes an interior channel defined by a plurality of walls of the at least one low-profile subduct and an intake channel coupled to the interior channel, wherein the interior channel and the intake channel form an exhaust channel configured to route exhaust from an exhaust source into the interior cavity of the main shaft body, wherein the at least one low-profile subduct is integrated into the at least one wall of the main shaft body such that at least one wall of the plurality of walls of the at least one low-profile subduct includes at least a portion of an interior surface of the at least one wall of the main shaft body, and wherein the at least a portion of the interior surface of the at least one wall of the main shaft body includes a flat portion of the interior surface.

2. The ventilation duct assembly of claim 1, wherein a first of the two parallel sides corresponds to a first of the two parallel axes perpendicular to the longitudinal axis and a second of the two parallel sides corresponds to a second of the two parallel axes perpendicular to the longitudinal axis, and wherein a first portion of the at least a portion of the at least one wall is disposed along the first of the two parallel sides parallel axes and a second portion of the at least a portion of the at least one wall is disposed along the second of the two parallel sides.

3. The ventilation duct assembly of claim 1, wherein the at least one low-profile subduct has a rectangular cross-sectional area.

4. The ventilation duct assembly of claim 3, wherein a pressure drop within the interior cavity of the main shaft body associated with the at least one low-profile subduct is less than a pressure drop within the interior cavity of the main shaft body associated with a subduct having a round cross-sectional area of a same size as the rectangular cross-sectional area of the at least one low-profile subduct.

5. The ventilation duct assembly of claim 1, wherein the at least one wall of the main shaft body includes one of:

a single wall; or a plurality of walls.

6. The ventilation duct assembly of claim 5, wherein the single wall includes a continuous segment of material formed into a shape of the main shaft body.

7. The ventilation duct assembly of claim 5, wherein the at least one wall of the main shaft body includes a set of contiguous segments of material, wherein each segment of the set of contiguous segments of material is attached to another segment of the set of contiguous segments of material to form a sheet of material, and wherein the sheet of material is formed into a shape of the main shaft body.

8. The ventilation duct assembly of claim 1, wherein one or more of the at least one wall of the main shaft body and the at least one low-profile subduct is configured to be fire resistant.

9. The ventilation duct assembly of claim 8, wherein one or more of:

one or more of the at least one wall of the main shaft body and the at least one low-profile subduct is of a fire-resistant material;

one or more of at least a portion of an interior surface of the at least one wall of the main shaft body and at least a portion of an interior surface of the interior channel of the at least one low-profile subduct includes a coating of a fire-resistant layer.

10. The ventilation duct assembly of claim 1, wherein one or more of the at least one wall of the main shaft body and the at least one low-profile subduct is configured with acoustic insulation.

11. The ventilation duct assembly of claim 10, wherein one or more of:

one or more of the at least one wall of the main shaft body and the at least one low-profile subduct is of an acoustic insulated material;

one or more of at least a portion of an interior surface of the at least one wall of the main shaft body and at least a portion of an interior surface of the interior channel of the at least one low-profile subduct includes a coating of acoustic insulation.

12. A method of manufacturing a ventilation duct assembly with integrated low-profile subducts, comprising:

disposing at least one wall defining a main shaft body around an interior cavity of the main shaft body, the interior cavity of the main shaft body extending from a proximal end to a distal end of the main shaft body along a longitudinal axis, wherein disposing the at least one wall includes disposing at least a portion of the at least one wall along two parallel axes perpendicular to the longitudinal axis, wherein a cross-sectional area of the main shaft body is formed to have an obround shape defined by two parallel sides and two round endpoints; and attaching at least one low-profile subduct to an interior surface of the at least one wall, the at least one low-profile subduct disposed within the interior cavity of the main shaft body between the proximal end and the distal end of the main shaft body, wherein attaching the at least one low-profile subduct to the interior surface of the at least one wall forms an interior channel of the at least one low-profile subduct, wherein the at least one low-profile subduct is integrated into the at least one wall of the main shaft body such that the at least one low-profile subduct and the interior surface of the at least one wall share at least a portion of the interior surface, and wherein the at least a portion shared by the at least one low-profile subduct and the interior surface of the at least one wall includes a flat portion of the interior surface.

13. The method of claim 12, wherein a first of the two parallel sides corresponds to a first of the two parallel axes perpendicular to the longitudinal axis and a second of the two parallel sides corresponds to a second of the two parallel axes perpendicular to the longitudinal axis, and wherein a first portion of the at least a portion of the at least one wall is disposed along the first of the two parallel sides parallel axes and a second portion of the at least a portion of the at least one wall is disposed along the second of the two parallel sides.

14. The method of claim 12, wherein attaching the at least one low-profile subduct to the interior surface of the at least one wall includes attaching a plurality of walls defining the interior channel of the at least one low-profile subduct to the interior surface of the at least one wall of the main shaft body, and wherein at least one wall of the plurality of walls of the at least one low-profile subduct includes the at least a portion shared by the at least one low-profile subduct and the interior surface of the at least one wall.

15. The method of claim 12, further comprising fabricating the at least one low-profile subduct to include a vertical section and a horizontal section, wherein the vertical section includes a vertical channel configured to route the exhaust from the exhaust source into the interior cavity of the main shaft body and the horizontal section includes an intake channel configured to route the exhaust from the exhaust source into the vertical channel of the vertical section.

16. The method of claim 15, further comprising forming the vertical section of the at least one low-profile subduct with a cross-sectional area having a rectangular shape.

17. The method of claim 12, wherein a pressure drop within the interior cavity of the main shaft body associated with the at least one low-profile subduct is less than a pressure drop within the interior cavity of the main shaft body associated with a subduct having a round cross-sectional area of a same size as the rectangular cross-sectional area of the at least one low-profile subduct.

18. The method of claim 12, further comprising fabricating the at least one wall defining the main shaft body, wherein fabricating the at least one wall defining the main shaft body includes one of:

forming a continuous segment of material into a shape of the main shaft body; or attaching each segment of a set of contiguous segments of material to another segment of the set of contiguous segments of material to form a sheet of material and forming the sheet of material into the shape of the main shaft body.

19. The method of claim 12, further comprising one of:

fabricating one or more of the at least one wall of the main shaft body and the at least one low-profile subduct using a fire-resistant material; or coating one or more of at least a portion of an interior surface of the at least one wall of the main shaft body and at least a portion of an interior surface of the interior channel of the at least one low-profile subduct with a fire-resistant layer.

20. The method of claim 12, further comprising one of:

fabricating one or more of the at least one wall of the main shaft body and the at least one low-profile subduct using an acoustic insulated material; or coating one or more of at least a portion of an interior surface of the at least one wall of the main shaft body and at least a portion of an interior surface of the interior channel of the at least one low-profile subduct with an acoustic insulation layer.

* * * * *